US007701478B2

(12) United States Patent
Murcia et al.

(10) Patent No.: US 7,701,478 B2
(45) Date of Patent: Apr. 20, 2010

(54) IMAGING HEAD MOUNT

(75) Inventors: Antoni S. Murcia, Poway, CA (US); Adam J. Livingston, San Marcos, CA (US); David L. Berardelli, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 932 days.

(21) Appl. No.: 11/105,696

(22) Filed: Apr. 14, 2005

(65) Prior Publication Data

US 2006/0232657 A1 Oct. 19, 2006

(51) Int. Cl.
*B41J 2/335* (2006.01)

(52) U.S. Cl. ..... 347/198

(58) Field of Classification Search ..... 347/198, 347/197, 220, 222, 106, 4
See application file for complete search history.

(56) References Cited

U.S. PATENT DOCUMENTS

| | | | |
|---|---|---|---|
| 6,149,262 | A | 11/2000 | Shiida et al. |
| 6,217,145 | B1 | 4/2001 | Ito et al. |
| 6,502,922 | B2 | 1/2003 | Kawase et al. |
| 6,511,153 | B1 | 1/2003 | Ishikawa |
| 2001/0038401 | A1 | 11/2001 | Kawase et al. |
| 2004/0263602 | A1 | 12/2004 | Nakashima et al. |

FOREIGN PATENT DOCUMENTS

| | | | |
|---|---|---|---|
| EP | 0088630 | A | 9/1983 |
| GB | 1379000 | A | 1/1975 |
| GB | 1430216 | A | 3/1976 |

OTHER PUBLICATIONS

*Family: Anti-Creep Linear Slides*, Del-Tron Precision Online Catalog, printed from website www.deltron.com/catalog/specifications on Feb. 10, 2005.

*Primary Examiner*—K. Feggins

(57) ABSTRACT

Various embodiments of an imaging head mount are disclosed.

35 Claims, 9 Drawing Sheets

IMAGING HEAD MOUNT

BACKGROUND

Good print quality may be dependent upon the spacing between an imaging head and media being printed upon. In some instances, the media may be abnormally thick, may include multiple sheets or may be irregular or bent. This may result in the media crashing into the imaging head and potentially damaging the imaging head.

DETAILED DESCRIPTION OF THE EXAMPLE EMBODIMENTS

Figure 1:
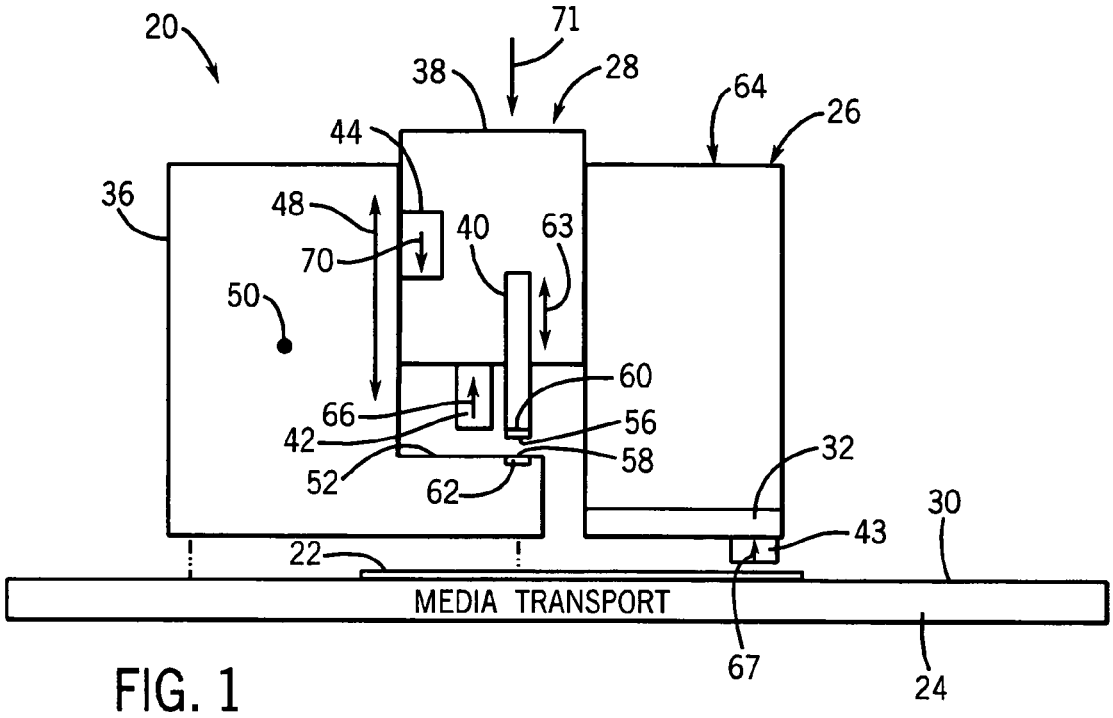
FIG. 1 is a schematic illustration of a printing system according to one exemplary embodiment.

FIG. 1 schematically illustrates a printing system 20 configured to print an image upon print medium 22 such as a sheet of paper or other material. Printing system 20 generally includes media transport 24, imaging head 26 and imaging head support 28. Media transport 24 comprises a device configured to transport or move media 22 relative to imaging head 26. In the embodiment shown, media transport 24 is configured to move media 22 in a generally flat plane along surface 30 relative to support 28. Such movement may be facilitated by one or more belts along surface 30. In other embodiments, media transport 24 may comprise a drum, one or more rollers, or other mechanisms for moving media relative to imaging head 26. Imaging head 26 comprises a device configured to eject a fluid, print or deposit printing material, such as ink, upon medium 22. In one embodiment, imaging head 26 (schematically shown) includes a plurality of printheads 32 through which the printing material is selectively deposited upon medium 22. In other embodiments, imaging head 26 may alternatively include a single printhead.

Imaging head support 28 movably supports imaging head 26 relative to medium 22 and media transport 24. In particular, support 28 facilitates movement of imaging head 26 away from media transport 24 in response to imaging head 26 crashing or otherwise contacting medium 22 such as when medium 22 includes multiple sheets, is abnormally thick or is irregular or bent. As a result, support 28 may reduce damage to printheads 32 while potentially enabling printheads 32 to be more closely spaced with respect to medium 22.

Imaging head support 28 generally includes base 36, mount 38, mount positioner 40, preload mechanism 42 and unidirectional dampener 44. Base 36 comprises one or more structures coupled to media transport 24 and configured to movably support mount 38 in the directions indicated by arrows 48. In one embodiment, base 36 bends or extends across media transport 24, allowing media transport 24 to move medium 22 between media transport 30 and base 36. In the particular example illustrated, base 36 is stationarily supported relative to media transport 24, wherein imaging head 26 includes printheads 32 that completely span medium 22 such as with a page-wide array of printheads. In other embodiments, base 36 may alternatively comprise a carriage configured to move along axis 50 so as to also move mount 38 and imaging head 26 across medium 22.

Base 36 includes a platform 52 configured to interact with mount positioner 40 as will be described in greater detail hereafter. In the particular example illustrated, platform 52 further interacts with preload mechanism 42 as will also be described in greater detail hereafter. In other embodiments, platform 52 may alternatively be provided by one or more surfaces or other structures fixed or at least temporarily retained vertically with respect to surface 30 of media transport 24.

Mount 38 comprises a structure coupled between base 36 and imaging head 26. For purposes of this disclosure, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

Mount 38 is movably coupled to base 36 for movement in the directions indicated by arrows 48. Mount 38 is stationarily coupled to imaging head 26. In the particular example shown, mount 38 is slidably coupled to base 36 and is releasably or removably coupled to imaging head 26. In other embodiments, mount 38 may be movably coupled to base 36 in other fashions and may be permanently coupled or fixed to imaging head 26. In some embodiments, mount 38 may be integrally formed as part of a single unitary body with imaging head 26.

Mount positioner 40 comprises one or more structures coupled to mount 38 and configured to interact with platform 52 of base 36 so as to regulate the positioning of mount 38 with respect to base 36 and to also regulate the positioning of imaging head 26 with respect to surface 30 of media transport 24. Positioner 40 projects from mount 38 and terminates at surface 56 generally opposite to surface 58 provided on platform 52. Surface 56 abuts or engages surface 58 to limit movement of mount 38 towards platform,52 and to limit movement of printhead 32 towards surface 30 of media transport 24. At the same time, surface 56 merely rests upon surface 58, allowing mount 38 to move away from media transport 24 in the event of printheads 32 or other structures associated with imaging head 26 crashing or otherwise contacting medium 22.

In the particular example shown, surfaces 56 and 58 are magnetically attracted towards one another. In one embodiment, both surfaces 56 and 58 may be provided by magnetic members 60 and 62 which have opposite polarities so as to be attracted towards one another. In other embodiments, one of surfaces 56 and 58 may be provided by a magnetic member while the other of surfaces 56 and 58 is provided by a ferrous material. In other embodiments, one or both of surfaces 56 and 58 may be non-magnetic, but may be in close proximity to the magnetized materials such that surfaces 56 and 58 are urged towards one another by magnetic forces. Because surfaces 56 and 58 are magnetically attracted towards one another, surface 56 is held adjacent to surface 58 during minor vibration and other movement generally insufficient to damage printheads 32 so as to maintain a predetermined spacing between imaging head 26 and medium 22; At the same time, however, surfaces 56 and 58 may be separated in response to sufficiently large forces being exerted against imaging head 26 to allow imaging head 26 to move away from medium 22.

In the particular example illustrated, mount positioner 40 is adjustably positioned in the direction indicated by arrows 63 with respect to mount 38. Surface 56 is movable between and configured to be selectively retained in one of a plurality of positions relative to surface 58. In one embodiment, positioner 40 may be screwed to mount 38 such that rotation of positioner 40 adjusts the positioning of surface 56. In another embodiment, one of positioner 40 and mount 38 may include a plurality of spaced detents while the other of positioner 40 and mount 38 includes a detent engaging protuberance, whereby selective positioning of the detent of the protuberance of one of the plurality of detents retains surface 56 in one of a plurality of positions. In still other embodiments, positioner 40 may be adjustably secured to mount 38 in other fashions. In some embodiments, positioner may alternatively be fixed relative to mount 38. Because surface 56 is adjustably positioned relative to surface 58, the spacing between printheads 32 and surface 30 of media transport 24 may also be adjusted to accommodate differing thicknesses of medium 22 or to vary spacing between printheads 32 and medium 22.

Preload mechanism 42 comprises a mechanism configured to apply a force to mount 38 in the direction indicated by arrow 66 so as to oppose the weight of mount 38, imaging head 26 and positioner 40 (collectively referred to as the imaging module 64). Preload mechanism 42 extends between mount 38 and platform 52 of base 36. In one embodiment, preload mechanism 42 includes a spring resiliently biasing mount 38 in the direction indicated by arrow 66. The force applied by preload mechanism 42 in the direction indicated by arrow 66 is typically less than the weight of imaging module 64. As a result, preload mechanism 42 generally does not result in surface 56 being lifted from surface 58 during normal operation. However, in the event of medium 22 crashing or otherwise contacting imaging head 26, preload mechanism 42 facilitates the lifting of imaging head 26 away from medium 22 and media transport 24 in response to a force less than the weight of imaging module 64.

In one embodiment, preload mechanism 42 applies a preload force to mount 38 and imaging head 26 for a predetermined period of time after a collision of imaging head 26 with medium 22. In one embodiment, preload mechanism 42 applies force to mount 38 in the direction indicated by arrow 66 until mount 38 has traveled a predetermined distance away from surface 30 of media transport 24 and platform 52 of base 36. In one embodiment, preload mechanism 42 is carried by mount 38 and is moved out of engagement with platform 52 after traveling a predetermined distance away from media transport 24 such that the application of force to mount 38 is ended.

Preload mechanism 43, like preload mechanism 42, is a device configured to apply a force to mount 38 and imaging head 26 in the direction indicated by arrow 67 so as to oppose the weight of module 64. Unlike preload mechanism 42, preload mechanism 43 is generally located between imaging head 26 and media transport 24. In one embodiment, preload mechanism 43 is carried by imaging head 26 and extends into engagement with media 22 or media transport 24. In one embodiment, preload mechanism 43 includes a spring resiliently biasing imaging head 26 in the direction indicated by arrow 67. As a result, preload mechanism 43 facilitates movement of imaging head 26 away from surface 30 of media transport 24 with an overall lower force than the weight of mount 38 and imaging head 26 in response to medium 22 crashing or otherwise contacting imaging head 26. Although printing system 20 is illustrated as including both preload mechanisms 42 and 43, system 20 may alternatively include one of preload mechanism 42 and 43.

Uni-directional dampener 44 comprises a mechanism operably coupled between base 36 and mount 38 configured to retard, resist or otherwise dampen relative movement of mount 38 relative to base 36 in a direction towards surface 30 of media transport 24 as indicated by arrow 70. Dampener 44 resists movement of mount 38 relative to base 36 in a direction opposite to arrow 70 by a first degree and resists movement of mount 38 relative to base 36 in the direction indicated by arrow 70 by a second greater degree. In one embodiment, dampener 44 applies little or no resistance to movement of mount 38 moving away from media transport 24 but slows movement of mount 38 towards media transport 24 so as to reduce potential damage to printheads 32 and to reduce occurrence of air ingested bubbles in nozzles of printhead 32 as a result of a rapid descent of imaging head 26 towards media transport 24.

In operation, media transport 24 moves medium 22 relative to printhead 32 of imaging head 26 while printhead 32 deposits ink or other printing material upon medium 22. During this time, surface 56 rests upon surface 58 under the force of gravity or additionally under a magnetic force between surfaces 56 and 58 to establish the spacing between printheads 32 and medium 22. Preload mechanism 42 and/or preload mechanism 43 apply a force to mount 38 and imaging head 26 that is typically less than the weight of mount 38 and imaging head 26 (and associated components). Upon impact with medium 22 of a sufficient magnitude, greater than the weight of mount 38, imaging head 26 and associated components less the force applied by preload mechanisms 42 and/or 43, surface 56 is lifted away from surface 58 and imaging head 26 is lifted away from medium 22. After ascending to a peak height or distance away from medium transport 24, imaging module 64 falls under the force of gravity, as indicated by arrow 71 towards media transport 24. During this fall, dampener 44 reduces the maximum speed of descent until surface 56 is once again brought into resting contact upon surface 58.

Figure 2:
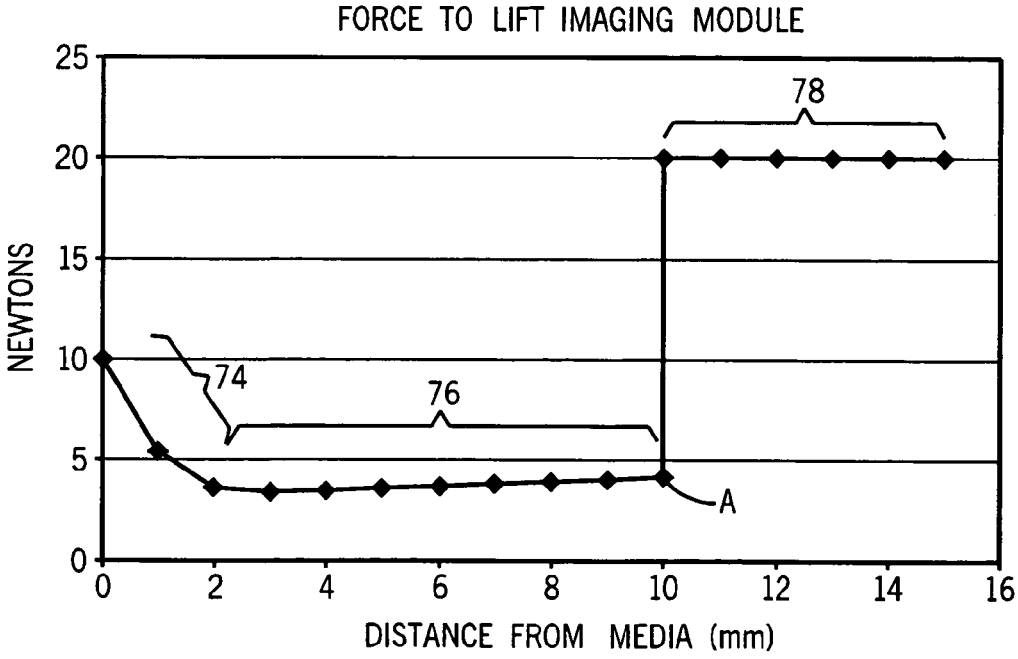
FIG. 2 is a graph depicting one example scenario of force to lift an imaging module of the system of FIG. 1 according to one exemplary embodiment.

FIG. 2 graphically illustrates an example of the force exerted to lift imaging module 64 after collision with medium 22. As illustrated by segment 74, the initial force exerted to lift module 64 is initially high due to the magnetic attraction between surfaces 56 and 58. However, as surfaces 56 and 58 become further separated from one another, the magnetic force fades as indicated by segment 74. As indicated by segment 76, the force exerted to lift module 64 remains relatively constant as preload mechanisms 42 and/or 43 assist in moving mount 38 and imaging head 26 away from medium 22. At a predetermined distance A from medium 22, preload mechanism 42 and/or 43 no longer apply a force to mount 38 and/or imaging head 26 in a direction away from media transport 24. As a result, as indicated by segment 78, the force exerted to move module 64 further away from medium 22 is substantially equal to the weight of module 64.

As shown by FIG. 2, the initial force exerted to lift or otherwise move module 64 including imaging head 26 away from medium 22 in response to colliding with medium 22 may be adjusted by varying the amount of magnetic force attracting surface 56 to surface 58 or by adjusting the amount of force applied by preload mechanism 42 and/or 43. In such a way, the response of mount 38 and imaging head 26 to collisions with medium 22 may be tuned to vary the mount of force exerted to module 64 including imaging head 26.

Figure 3:
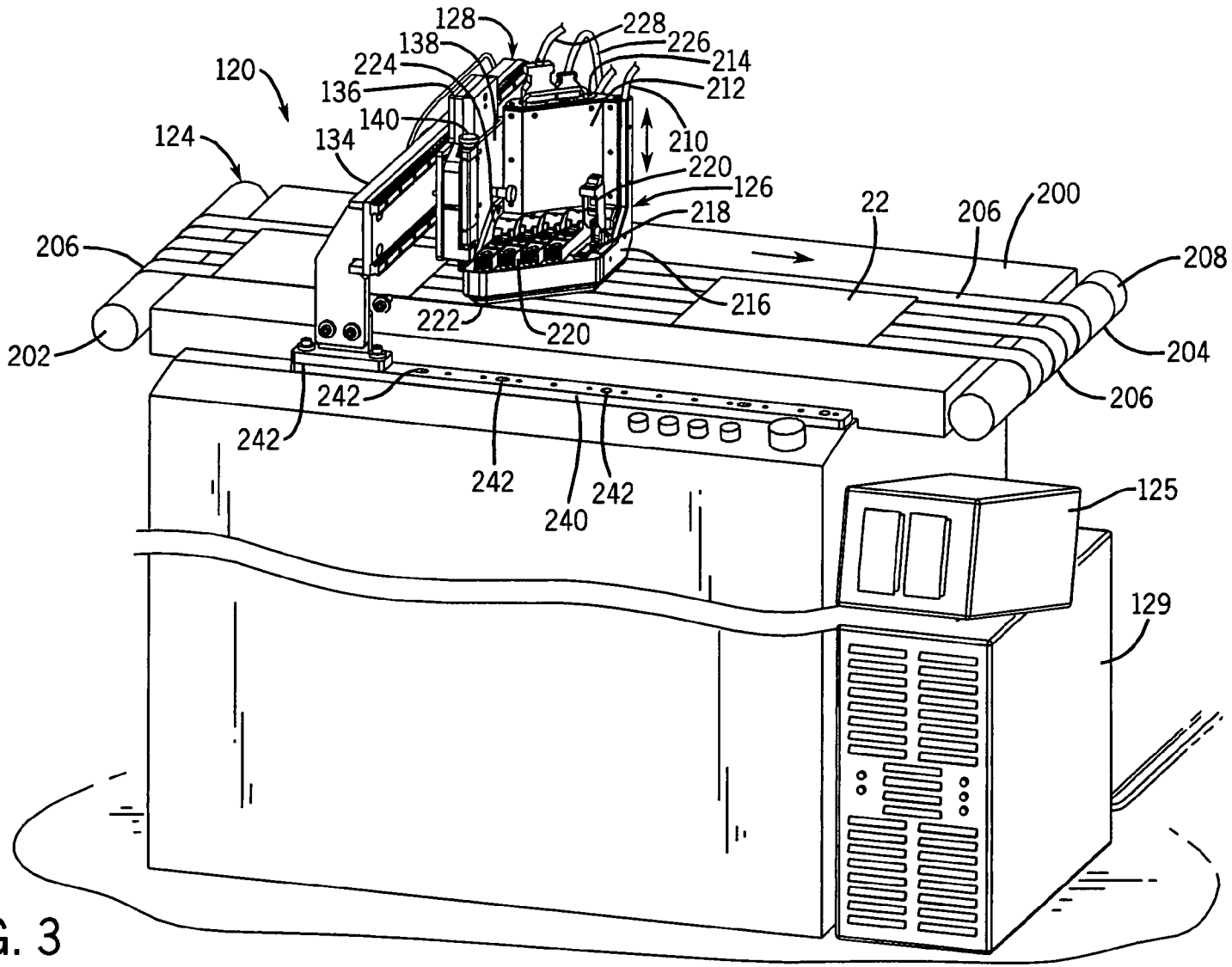
FIG. 3 is a perspective view of another embodiment of the printing system of FIG. 1 according to one exemplary embodiment.

FIG. 3 illustrates printing system 120, an example embodiment of printing system 20 shown in FIG. 1. Printing system 120 generally includes media transport 124, fluid delivery system 125, imaging head 126, imaging head support 128 and controller 129. Media transport 124 moves medium 22 beneath and relative to imaging head 126. In the particular example shown, media transport 124 includes table 200, rollers 202, 204, belts 206 and encoder 208. Table 200 comprises a substantially flat member upon which belts 206 carry medium 22 relative to imaging head 126. In the particular example shown, table 200 also serves as a frame or foundation for support 128.

Rollers 202, 204 comprise cylindrical members rotatably coupled to table 200 on opposite ends of table 200. Rollers 202, 204 are in engagement with belts 206. At least one of rollers 202, 204 is operably coupled to a motor (not shown) so as to be rotatably driven and so as to drive belts 206 along table 200. In other embodiments, rollers 202, 204 may have configurations other than that shown. Moreover, in particular embodiments, roller 202 may be omitted, wherein table 200 has a rounded end configured to permit belts 206 to move about the end of table 200.

Encoder 208 comprises a mechanism coupled to roller 204 configured to sense or detect rotation of roller 204. Encoder 208 generates signals representing the rotation of roller 208 and transmits such signals to controller 129. The signals generated by encoder 208 enable controller 129 to control the rotation of roller 202, 204 and the positioning of medium 22 on belts 206 below imaging head 126.

Belts 206 comprise elongate endless webs extending about table 200 and about rollers 202, 204. Belts 206 are configured to be driven by rotation of one or both of rollers 202, 204. Although media transport 124 is illustrated as including three spaced belts 206, media transport 124 may alternatively include a greater or fewer number of such belts. In still other embodiments, other mechanisms may be used to transport medium 22 such as movable shuttle trays, rollers and the like.

Fluid delivery system 125 generally comprises a device configured to contain and selectively pump or supply fluid, such as ink, to imaging head 126 through fluid line 210. In other embodiments, other mechanisms may be used to supply fluid to imaging head 126. In still other embodiments, imaging head 126 may alternatively include self-contained fluid reservoirs.

Imaging head 126 comprises a device configured to eject and deposit fluid, such as ink upon medium 22 as medium 22 is moved by media transport 124. In other embodiments, imaging head 126 may alternatively be configured to print on more three-dimensional structures such as packaging, containers or articles. Imaging head 126 generally includes body 212, imaging head controller 214, fluid manifold 216, printheads 218, latches 220 and deflector 222. Body 212 supports, houses and contains the remaining components of imaging head 126. Body 212 includes an interface 224 configured to be removably mounted to imaging head support 128. Body 212 additionally includes an internal cavity (not shown) which receives imaging head controller 214.

Imaging head controller 214 comprises a processing unit configured to generate control signals for the direction of printheads 218 based upon data received from printing system controller 129 and/or an external computing device (not shown) received through data line 226. In one embodiment, controller 214 includes electronics supported on a printed circuit board (not shown) received within body 212. Controller 214 further transmits and controls distribution of power to printheads 218 received via power line 228.

Fluid manifold 216 distributes fluid, such as ink, received via fluid line 210, to each of printheads 218. Manifold 216 includes internal conduits (not shown) through which ink is distributed to printheads 218. A more detailed description of manifold 216 is found in co-pending U.S. patent application Ser. No. 11/043,519 filed on Jan. 26, 2005, by Perez et al. and entitled FLUID-DELIVERY MECHANISM FOR FLUID-EJECTION DEVICE, the full disclosure of which is hereby incorporated by reference.

Figure 4:
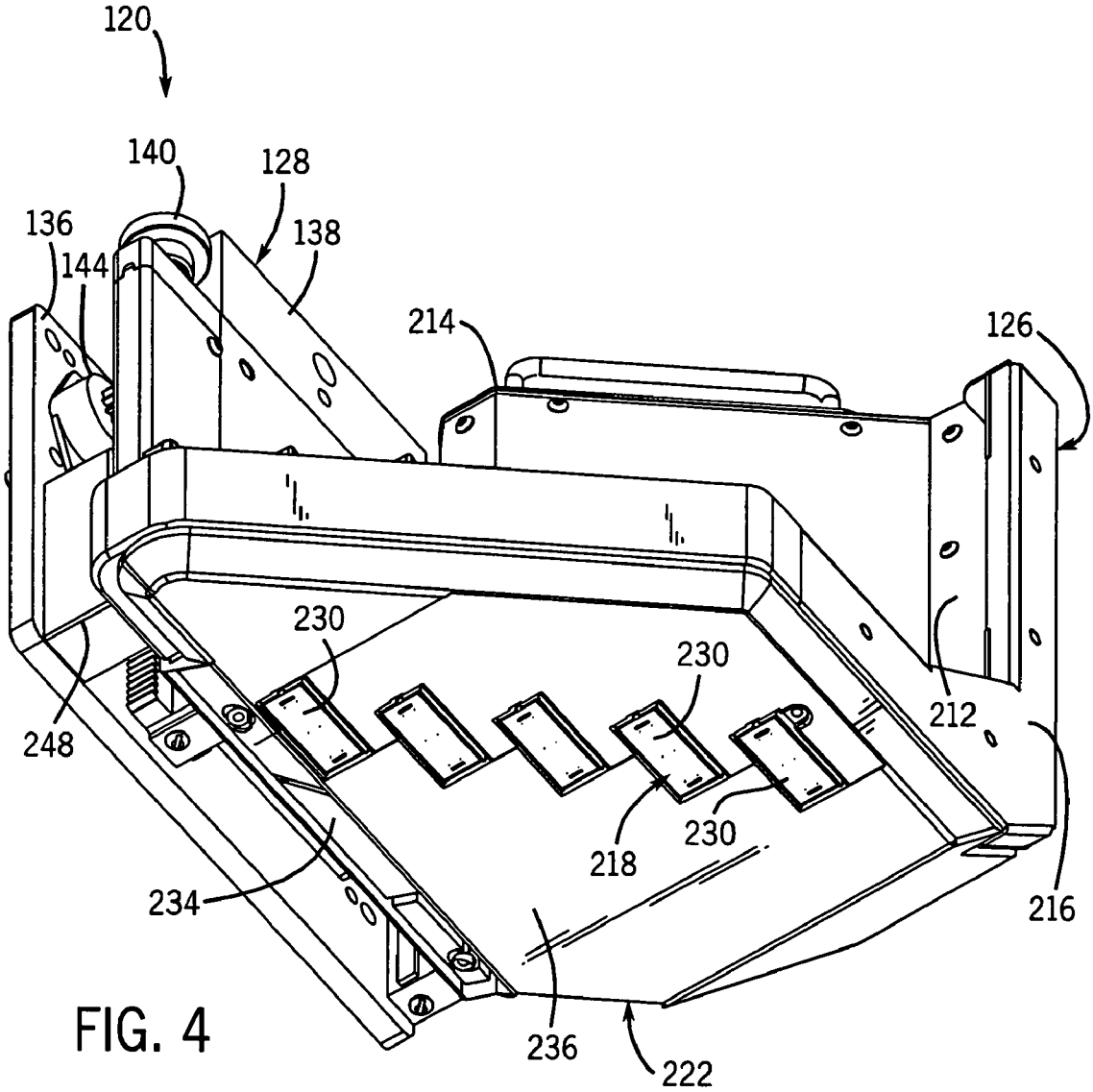
FIG. 4 is a bottom perspective view of an imaging head and support of the printing system of FIG. 3 according to one exemplary embodiment.

Printheads 218 comprise thermoresistive printheads configured to selectively eject fluid, such as ink, through individual nozzles. As shown in FIG. 4, each printhead includes a nozzle plate 230 including nozzles through which fluid, such as ink, is ejected. In other embodiments, printheads 218 may comprise other forms of printheads such as piezo electric printheads. Although imaging head 126 is illustrated as including five offset and spaced printheads 218, imaging head 126 may alternatively include a greater or fewer number of such printheads.

Latches 220 comprise mechanisms configured to releasably retain printheads in place in body 212 and in connection with manifold 216. As shown by FIG. 3, latches 220 pivot between a closed position and an open position, allowing printheads 218 to be withdrawn or inserted. In other embodiments, latches 220 may be omitted where printheads 218 are permanently affixed to or as part of body 212 and/or manifold 216.

Deflector 222 comprises a structure generally facing table 200 and extending about printheads 218. As shown by FIG. 4, deflector 222 includes a beveled forward edge 234 shaped so as to funnel bent media down towards table 200 (shown in FIG. 3) such that the media does not scratch nozzle plates 230 of printheads 218. As further shown by FIG. 4, deflector 222 includes a lower surface or bottom 236 which extends beyond and below nozzle plates 230. As a result, media contacts the bottom of deflector 222 rather than nozzles plates 230. In the particular example shown, bottom 236 of deflector 222 is spaced about 0.4 millimeters lower than nozzle plates 230. In other embodiments, deflector 222 may have other shapes and configurations as well as other relative spacing with respect to nozzle plates 230.

Although imaging head 126 is illustrated as utilizing a manifold 216 to distribute ink to printheads 218, imaging head 126 may alternatively distribute fluid or ink to printheads 218 by individual tubes or other fluid delivery structures. Although printheads 218 are illustrated as removably supported by body 212, printheads 218 may alternatively be permanently affixed to body 212 or other structures of imaging head 126. Overall, imaging head 126 may have various other shapes, configurations and components.

Imaging head support 128 movably supports imaging head 126 relative to table 200 and medium 22 being moved by media transport 124. As will be described in greater detail hereafter, imaging head support 128 additionally allows movement of imaging head 126 away from table 200 in response to media collisions to prevent or minimize damage to imaging head 126. As shown in FIG. 3 and illustrated in detail in FIG. 5, support 128 generally includes suspension 134, base 136, mount 138, positioner 140, preload mechanism 142 and unidirectional dampener 144. As shown by FIG. 3, suspension 134 comprises a structure configured to suspend base 36, mount 38 and ultimately imaging head 26 above table 200. In the particular example shown, suspension 134 comprises an elongate beam spanning table 200 and mounted to bracket 240 at one of multiple mounting locations 242 to facilitate repositioning of suspension 134 along table 200 or to enable additional suspensions 134 and their supported imaging heads 126 to be mounted along table 200. In other embodiments, suspension 134 may alternatively include a rod, bar or other structure extending over table 200. In other embodiments, suspension 134 may be additionally configured to movably support base 136, mount 138 and imaging head 126 for movement across table 200.

Figure 5:
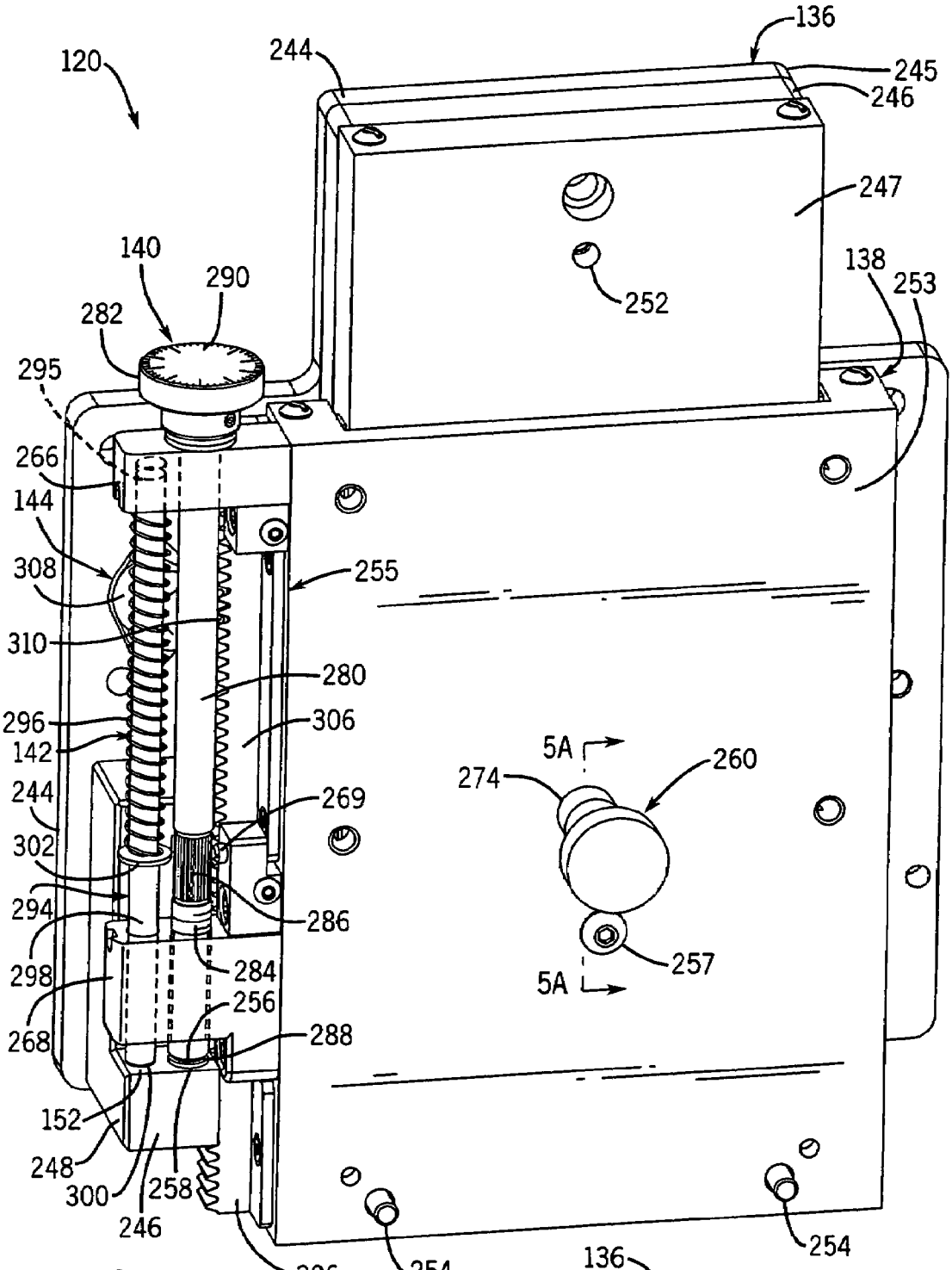
FIG. 5 is a perspective view of a base and mount of the support of FIG. 4 according to one exemplary embodiment.

Base 136 comprises a structure removably mounted to suspension 134 above table 200. As shown by FIG. 5, base 136 includes platform 152 extending below positioner 140 and preload mechanism 142. In the particular embodiment illustrated, base 136 generally includes back plate 245, spacer plate 246, base plate 247 and a bar 248 secured to plate 245 and providing platform 152. Back plate 245 generally comprises a plate supporting bar 248 and mounted to suspension 134 (shown in FIG. 3). Spacer plate 246 is sandwiched between back plate 245 and base plate 247 to space such plates. Base plate 247 is mounted to spacer plate 246 and slidably interfaces with mount 138. In the particular example shown, base plate 247 additionally includes detents 252 for selectively retaining mount 138 relative to base 136 at a plurality of positions. In other embodiments, base 136 may have other configurations.

Mount 138 generally comprises a structure coupled between base 136 and imaging head 126 (shown in FIG. 3). Mount 138 is configured to move relative to base 136 in a vertical direction. In the particular embodiment illustrated, mount 138 is removably attached to imaging head 126 by fasteners such as dowel pins 254 configured to extend into corresponding apertures in interface 224 of body 212 of imaging head 126 and screw 257 extending through interface 224 (shown in FIG. 1) into mount 138. In other embodiments, mount 138 may be coupled to imaging head 126 by other fasteners or by permanent welds or bonds. In some embodiments, mount 138 may alternatively be integrally formed as part of a single unitary body with interface 224 or body 212 of imaging head 126.

In the particular example shown, mount 138 is configured to slide in a vertical direction relative to base 136. Mount 138 generally includes carriage 253 and bracket 255. Carriage 253 is configured so as to wrap about base plate 247 to slidably couple mount 138 to base 136. Bracket 255 is mounted to carriage 253 and is configured to support positioner 140 and preload mechanism 142.

Figure 5A:
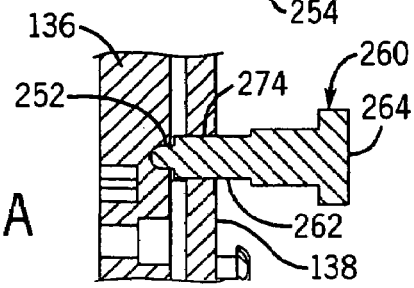
FIG. 5A is a sectional view of the base and mount of FIG. 5 taken along line 5A-5A according to one exemplary embodiment.

In the particular example illustrated, mount 138 additionally includes lock 260. Lock 260 comprises a pin or other projection configured to be removably inserted into one of detents 252 along plate 247 to releasably retain mount 138 in one of a plurality of positions with respect to base 136. As shown by FIG. 5A, lock 260 comprises a threaded shaft 262 having a knob 264, wherein the threaded shaft 262 is threaded through a threaded opening 274 and inserted into one of detents 252. In another embodiment, shaft 262 may omit threads and may be inserted into threaded detents 252. In another embodiment, lock 260 may comprise a spring biased pin, wherein a spring (not shown) resiliently biases the pin towards and into one of detents 252. In still other embodiments, lock 260 may be omitted.

According to one exemplary embodiment, base plate 247 and carriage 253 comprise a linear slide such as those commercially available from Del-Tron Precision, Inc., of Bethel, Conn., wherein carriage 253 is slidably coupled to base plate 247 by ball bearings. In other embodiments, mount 138 may have other configurations and may be slidably or otherwise movably coupled to base 136 by other mechanisms or slow-friction interfaces.

Positioner 140 comprises a structure coupled to mount 138 and configured to interact with platform 152 of base 136 to position mount 138 and imaging head 126 (shown in FIG. 1) relative to table 200 (shown in FIG. 3). In the particular example shown, positioner 140 generally includes shaft 280 and knob 282. Shaft 280 extends through portions 266 and 268 of bracket 255 of mount 138. Shaft 280 includes a threaded portion 284, a knurled portion 286 and tip 288. Threaded portion 284 engages corresponding threads and lower portion 268 of bracket 255 such that rotation of shaft 280 moves tip 288 relative to platform 152. The positioning of tip 288 relative to platform 152 establishes spacing between imaging head 126 and table 200. At the same time, however, because tip 288 merely rests upon platform 152, positioner 140 enables imaging head 126 (shown in FIG. 1) and mount 138 to be lifted off of platform 152 in response to a collision with medium 22. In the particular example shown, tip 288 has a ferrous surface 256 and is magnetically attracted towards platform 152 which includes a magnetic surface 258. The magnetic attraction between tip 288 and platform 152 maintains tip 288 in contact with platform 152 during vibration and other insubstantial movement of imaging head 126. In other embodiments, tip 288 may additionally be magnetized or may alternatively be magnetized where surface 258 of platform 152 includes a ferrous material. In still other embodiments, tip 288 and platform 152 may not be magnetized.

Knurled portion 286 comprises a roughened area configured to interact with a resiliently flexible projection 269 of bracket 255 to inhibit unintended rotation of shaft 280. In the particular example shown, knurled portion 286 includes a plurality of axial serrations or grooves and engaged by projection 269. In other embodiments, projection 269 may be rigid while knurled portion 286 is resiliently flexible. In other embodiments, other means may be used to inhibit unintentional rotation of shaft 280 and to maintain tip 288 in an established position with respect to platform 152.

Knob 282 is fixed to shaft 280 and is configured to facilitate manual rotation of shaft 280 to reposition tip 288 with respect to platform 152. In the particular example shown, knob 282 includes radial index marks 290 which indicate linear movement of tip 288 brought about by angular rotation of knob 282. In other embodiments, other structures may be provided for facilitating manual rotation of shaft 280.

Preload mechanism 142 comprises a component configured to apply an upward force to mount 138 and imaging head 126 so as to reduce the minimum amount of force for lifting image head 126 away from table 200 (as shown in FIG. 1). Preload mechanism 142 generally includes shaft 294 and spring 296. Shaft 294 has an upper end 295 slidably received within upper portion 266 of bracket 255, an intermediate portion 298 slidably passing through lower portion 268 of bracket 255, a tip 300 below lower portion 268 opposite to platform 152 and a shoulder 302 between upper portion 266 and lower portion 268 of bracket 255. Spring 296 comprises a compression spring captured between shoulder 302 and upper portion 266 of bracket 255. Upward movement of shaft 294 relative to bracket 255 compresses spring 296, causing spring 296 to apply an upward force to bracket 255, to mount 138 and ultimately to imaging head 126 to oppose the weight of mount 138 arid imaging head 126 and to lessen the amount of force for lifting imaging head 126 away from medium 22 (shown in FIG. 1). Upon sufficient lifting of imaging head 126 and mount 138 away from medium 22, tip 300 is lifted from platform 152 such that spring 296 no longer applies an upward force to mount 138 and imaging head 126.

Uni-directional dampener 144 slows down the free fall motion of imaging head 126 while providing little resistance to upward motion of imaging head 126. Uni-directional dampener 144 includes rack gear 306 and uni-directional rotary dampener 308. Rack gear 306 is coupled to mount 138. Uni-directional rotary dampener 308 includes a pinion gear 310 (shown in FIG. 8) in meshing engagement with rack gear 306. Rotary dampener 308 resists upward movement of mount 138 by a first degree and resists downward movement of mount 138 and imaging head 126 by a second greater degree. In one embodiment, uni-directional rotary dampener 308 comprises a clockwise rotary damper such as a 5-newton*cm damper, part no. RN-D2-R501-G1 commercially available from Ace Controls. In other embodiments, uni-directional dampener 144 may comprise other structures. For example, in another embodiment, rack 306 may alternatively be coupled to base 136 while unidirectional rotary dampener 308 is coupled to mount 138. In other embodiments, other mechanisms may be used to slow descent speed of mount 138 and imaging head 126.

Figure 6:
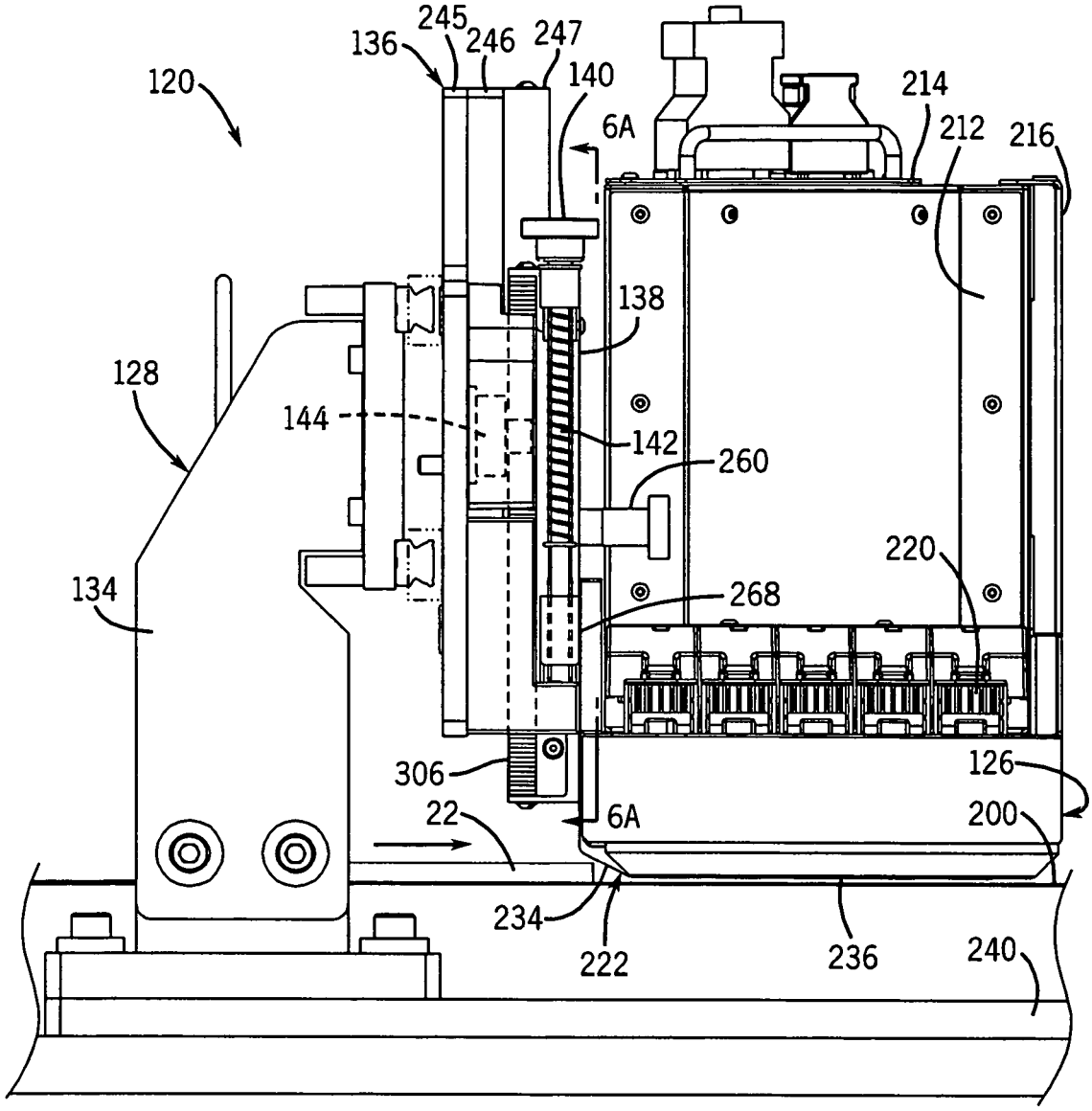
FIG. 6 is a side elevational view of the printing system of FIG. 3 in a printing position according to one exemplary embodiment.
Figure 6A:
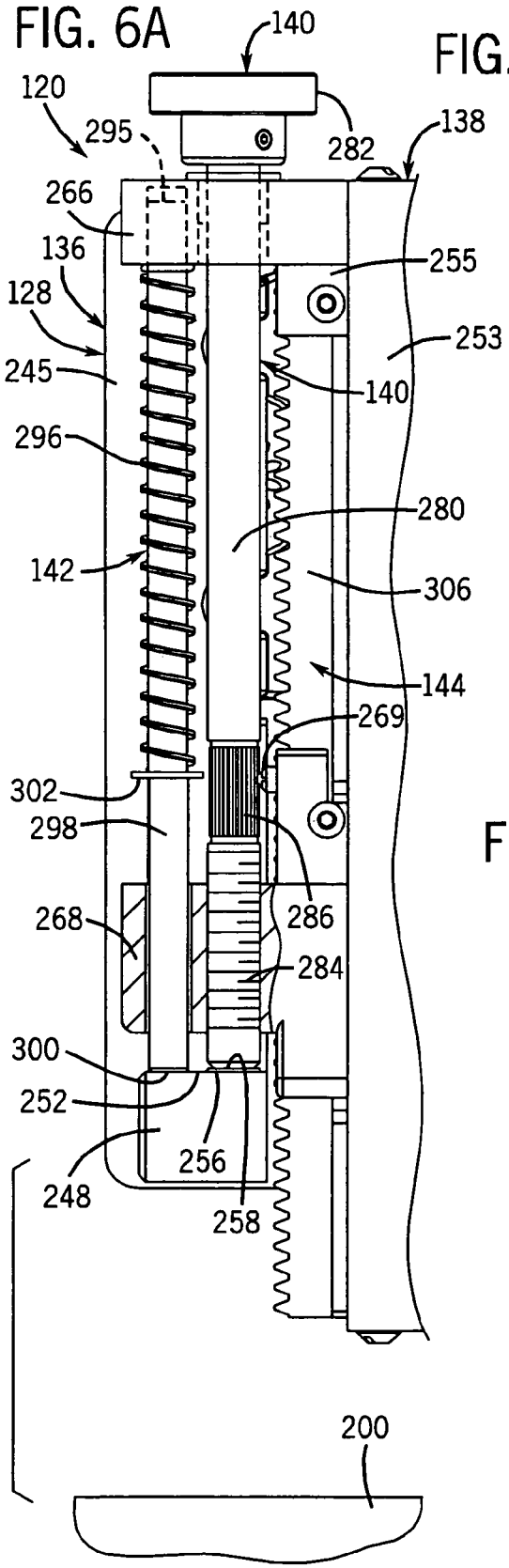
FIG. 6A is a fragmentary elevational view of the system of FIG. 6 taken along line 6A-6A.
Figure 7A:
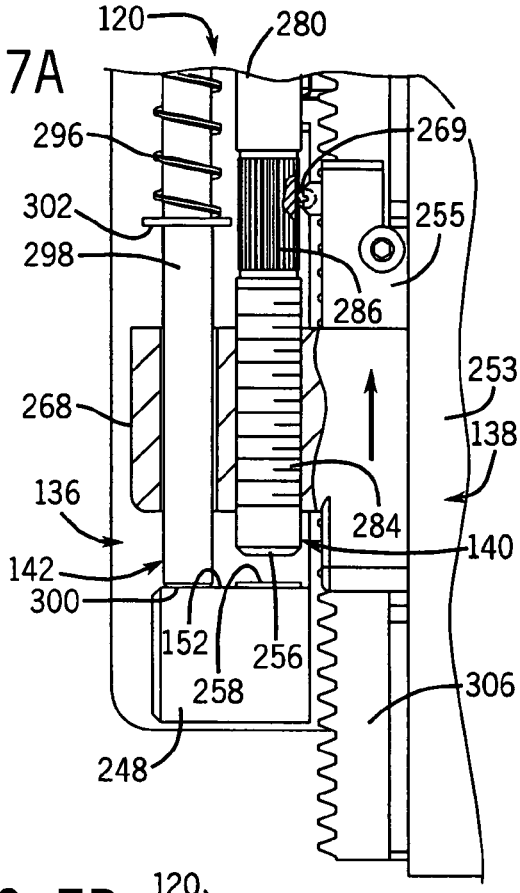
FIG. 7A is a fragmentary end elevational view of the system of FIG. 7 taken along line 7A-7A illustrating the initial upward movement of the imaging head according to one exemplary embodiment.
Figure 7B:
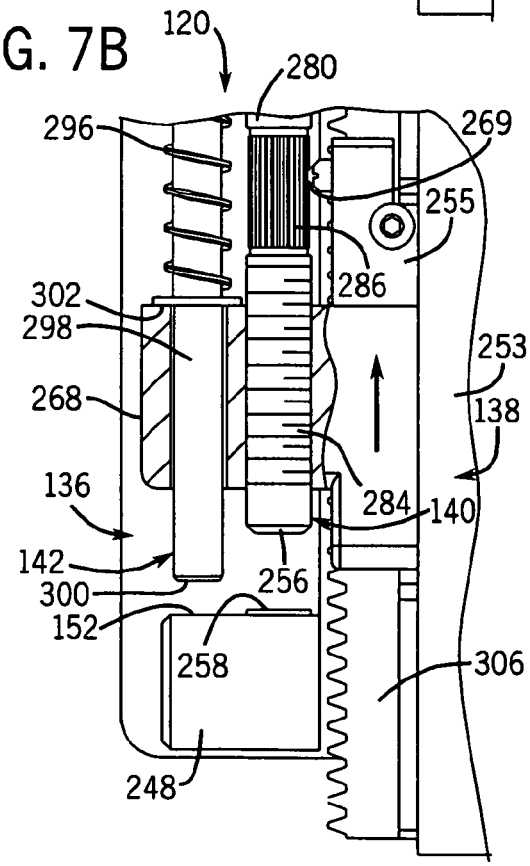
FIG. 7B is a fragmentary elevational view of the system of FIG. 7 taken along line 7B-7B illustrating the further upward movement of the imaging head according to one exemplary embodiment.
Figure 7:
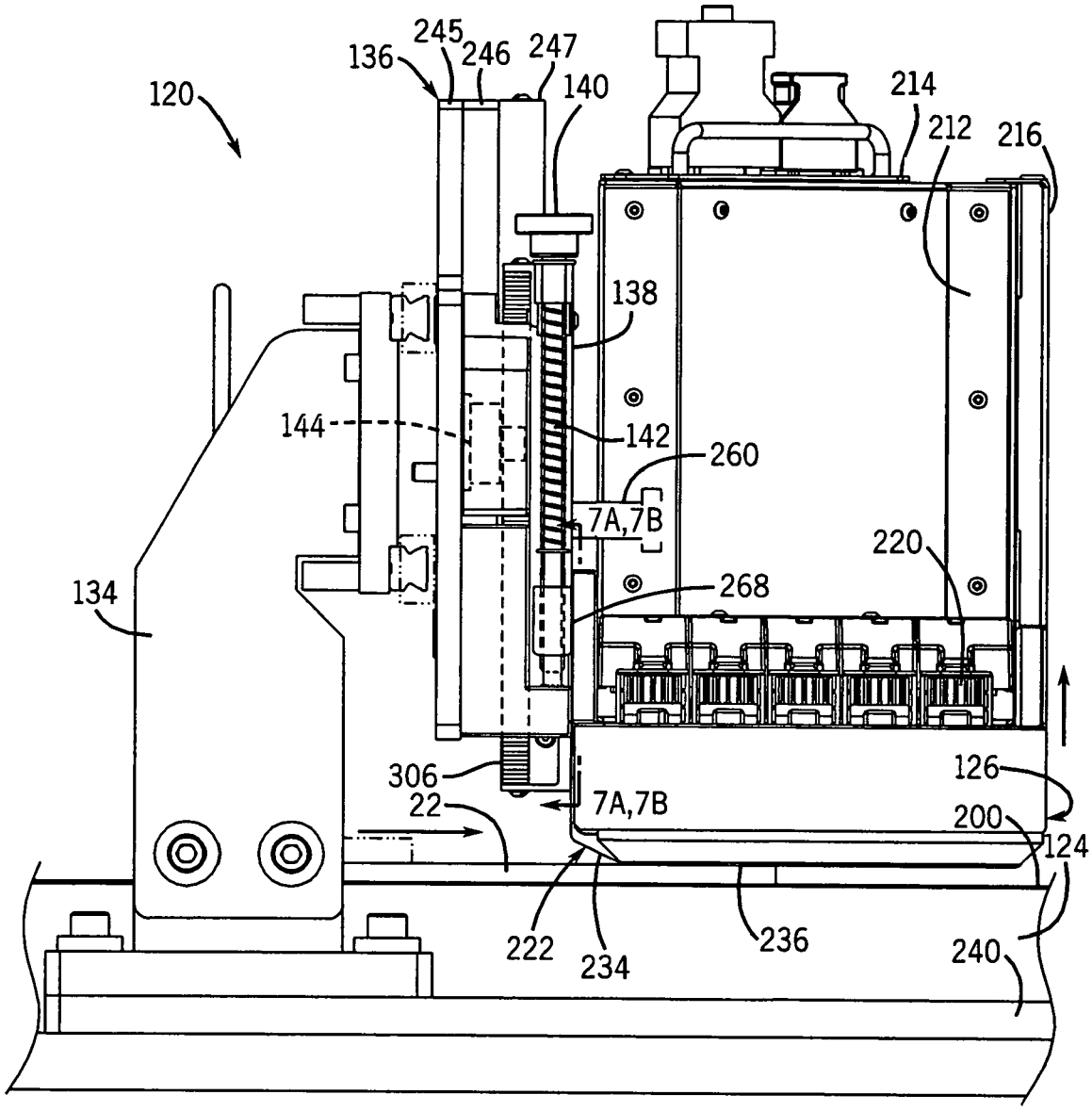
FIG. 7 is a side elevational view of the printing system of FIG. 6 illustrating collision of a medium with an imaging head according to one exemplary embodiment.
Figure 8:
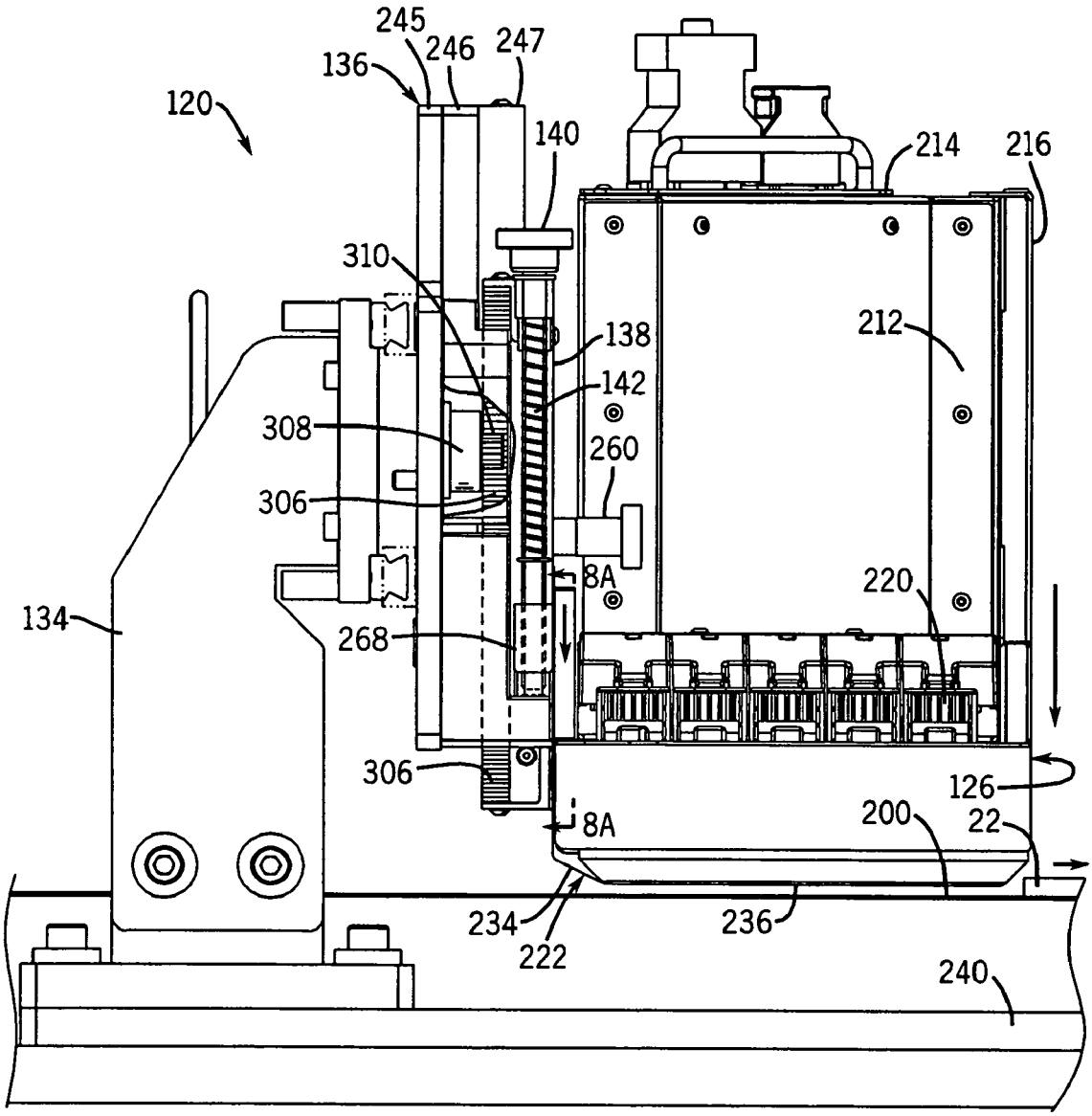
FIG. 8 is a side elevational view of the printing system of FIG. 6 illustrating descent of the imaging head according to one exemplary embodiment.

FIGS. 6-8 illustrate various positions of imaging head 126 with respect to table 200 (shown in FIGS. 6, 6A, 7. and 8) in various example states of positioner 140 and preload mechanism 142. FIGS. 6 and 6A illustrate imaging head 126 supported by support 128 relative to table 200 in a lowered position for printing upon a medium. In the lowered position, printheads 218 are supported in close proximity with medium 22 to facilitate print quality. In one embodiment, printheads 218 may be spaced as close to table 200 as one millimeter. In other embodiments, printheads 218 may be supported so as to be spaced from table 200 by other distances. When imaging head 126 is in the lowered position, tip 288 is in contact with and rests upon magnetic surface 258 of platform 152. When imaging head is in the lowered printing position, tip 300 of preload mechanism 142 is in contact and rests upon platform 152 and spring 296 is in a state of compression so as to apply an upward lifting force to mount 138. In one particular embodiment, imaging head 126 is urged by gravity towards table 200 with a force of about 20 newtons while spring 296 applies an upward lifting force of about 15 newtons. As a result, an additional upward force caused by a collision between a medium and imaging head 126 of at least 5 newtons may cause image head 126 to be moved away from table 200 and may cause positioner 140 to be separated from platform 152 once the initial magnetic traction between tip 288 and magnetic surface 258 of platform 152 has been broken and has faded. In other embodiments, the force applied by preload 142 may be varied and the magnetic attraction between tip 288 and platform 152 may be omitted.

FIGS. 7, 7A and 7B illustrate media transport 124 moving a relatively thick sheet of media 22 beneath imaging head 126. The thickness of medium 22 shown in FIG. 7 is greater than the spacing between bottom 236 of deflector 222 and table 200 when imaging head 126 is in the lowered position in which tip 288 rests upon magnetic surface 258 of platform 152. As shown by FIG. 7, the thickness of media 22 causes medium 22 to impact deflector 222. In particular, medium 22 initially engages ramp 234 and then is moved across bottom 236 by deflector 222 out of substantial contact with nozzle plates 230 (shown in FIG. 4) of printheads 218. With engagement of medium 22 with deflector 222, the magnetic attraction between tip 288 and magnetic surface 258 of platform 152 is broken and tip 288 is lifted from magnetic surface 258 of platform 152 with the assistance of spring 296 of preload mechanism 142 to move imaging head 126 above medium 22 and to reduce potential damage to printheads 118. As shown by FIG. 7B, after imaging head 126 has traveled a sufficient distance upward away from table 200 and medium 22, the lifting force, applied by preload mechanism 142 is terminated as shaft 294 reaches its end of travel such as when shoulder 302 contacts lower portion 268 of bracket 255. At such point in time, tip 300 is lifted from platform 152. As a result, the force exerted upon imaging head 126 to further lift imaging head 126 would exceed the weight of imaging head 126, mount 138 and any other components weighing down imaging head 126.

Figure 8A:
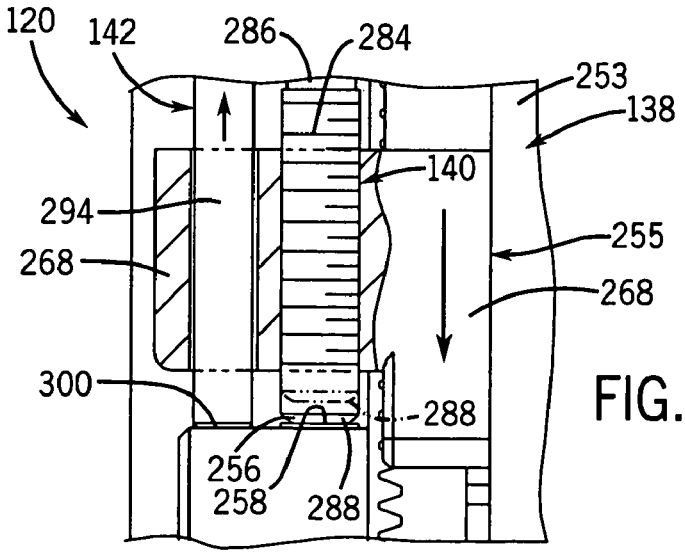
FIG. 8A is an end elevational view of the system of FIG. 8 taken along line 8A-8A illustrating completion of the descent of the imaging head according to one exemplary embodiment.

FIG. 8 illustrates imaging head 126 after medium 22 has been expelled by media transport 124. As shown by FIG. 8, once media 22 has been expelled, imaging head 126 starts to fall towards table 200 under its weight. However, unidirectional dampener 144 slows down or reduces the rate of descent of imaging head 126. As a result, uni-directional dampener 144 reduces the possibility for strong impacts and further lessens the ingestion of air through nozzle plates 230 of printheads 218 which may create bubbles within printheads 218. As shown by FIG. 8A, imaging head 126 continues to fall until tip 288 is once again brought into resting contact with magnetic surface 258 of platform 152 and until tip 300 is brought into resting contact with platform 152, compressing spring 296. After this has occurred, imaging head 126 once again is in its lowered position ready for further printing upon sheets of media.

Figure 10:
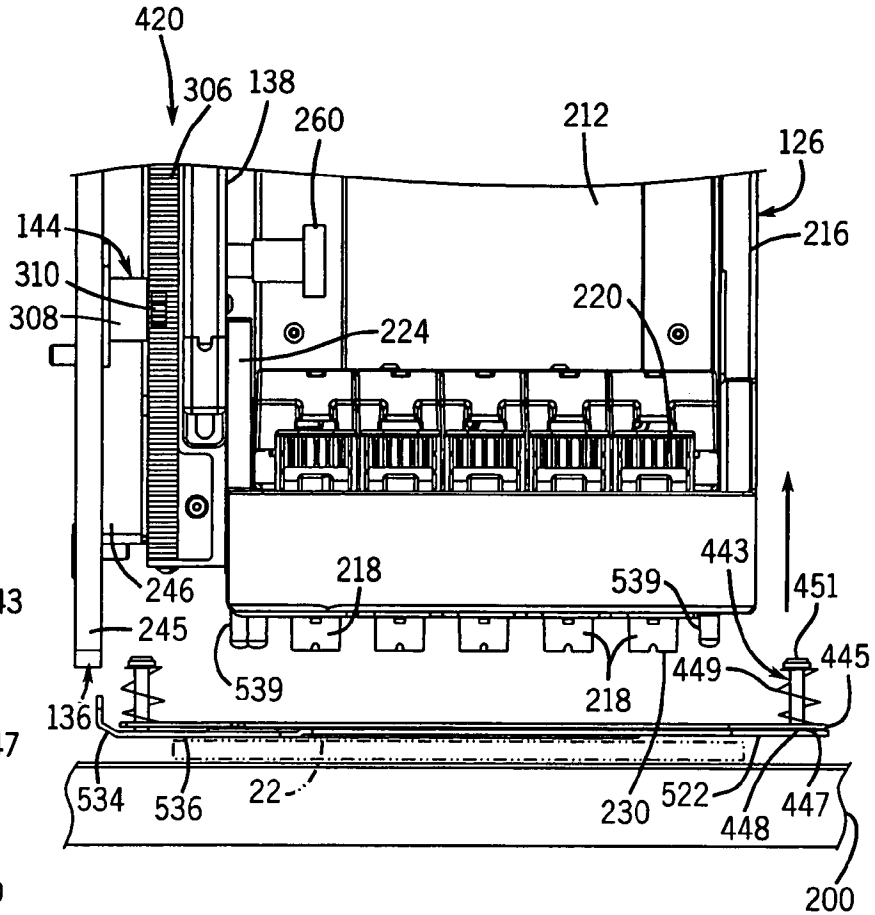
FIG. 10 is a side elevational view of the system of FIG. 9 illustrating removal of the preload mechanism and a deflector according to one exemplary embodiment.
Figure 9:
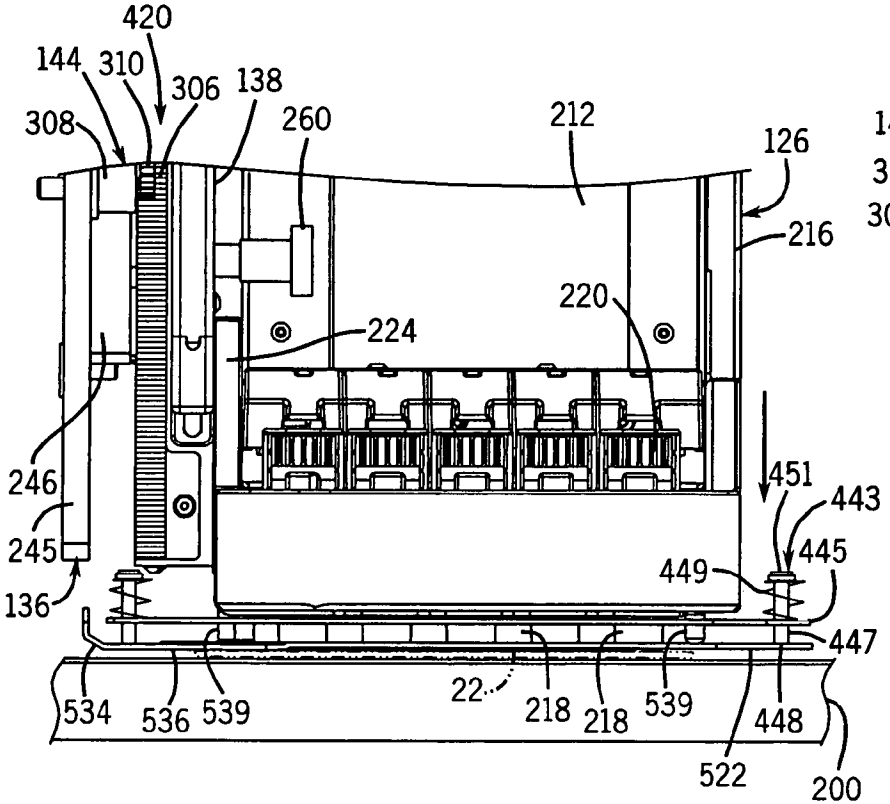
FIG. 9 is a fragmentary side elevational view of another embodiment of the printing system of FIG. 3 illustrating a preload mechanism coupled to an imaging head according to one exemplary embodiment.

FIGS. 9 and 10 illustrate printing system 420, another embodiment of printing system 20 shown in FIG. 1. Printing system 420 is similar to printing system 120 (shown in FIGS. 2-8) except that printing system 420 includes preload mechanism 443 in lieu of preload mechanism 444 and deflector 522 in lieu of deflector 222. Those remaining elements of printing system 420 that are substantially similar to those elements of printing system 120 are numbered similarly. Preload mechanism 443, like preload mechanism 142, exerts an upward force to imaging head 126, countering the weight of imaging head 126. As a result, less force and collision from a medium and imaging head 126 will lift imaging head 126 away from the medium 22. Preload mechanism 443 includes base 445, shafts 447, and spring 449. Base 445 comprises an elongate member removably coupled to imaging head 126, facilitating the replacement or exchange of deflector 522 and preload mechanism 443 as shown in FIG. 10. In the particular embodiment illustrated, base 445 comprises a plate releasably coupled to body 212 and manifold 216. In other embodiments, base 445 may be removably coupled to mount 138 or may be fixedly coupled or integrally formed as part of a single unitary body with imaging head 126 or mount 138.

Shafts 447 comprise elongate members slidably passing through base 445. Shafts 447 each have a lower end 448 fixed to deflector 522 and an opposite upper end terminating at a head 451. Springs 449 comprise compression springs extending about shafts 447 and captured between base 445 and head 451. When compressed, springs 448 apply a force to head 451, biasing head 451, shaft 447 and deflector 522 in an upward direction away from table 200.

Deflector 522 comprises a structure configured to protect nozzle plates 230 (shown in FIG. 4) of printheads 218 from any media passing between table 200 and printheads 218. Deflector 522 is fixed to shafts 447 and includes ramp 534 and bottom 536. Ramp 534 comprises a sloped or beveled surface facing the direction in which media is supplied to imaging head 126. Ramp 434 is configured to funnel or direct bent media downward towards table 200 to minimize scratching of nozzle plates 230. In one particular embodiment, ramp 534 is inclined at an angle of nominally about 30 degrees. In other embodiments, ramp 534 may be inclined at other angles or may be omitted.

Bottom 536 extends from ramp 534 beneath printheads 218 of imaging head 126. Bottom 536 is configured so as to generally extend parallel to table 200 and includes openings through which printheads 218 eject ink onto media being carried by table 200. In one particular embodiment, bottom 536 includes upwardly extending recesses about printheads 218, further spacing printheads 218 from table 200.

As shown by FIG. 9, bottom 536 is engaged by projections or legs 539 projecting from a lower end of imaging head 126 to a point below base 445. Legs 539 space bottom 536 of deflector 522 from base 445 and define the location of deflector 522 with respect to printheads 218. The spacing of deflector 522 from base 445 also results in spring 499 being compressed and exerting an opposite lifting force to imaging head 126 through shaft 447, deflector 522 and legs 539. Although imaging head 126 is shown as additionally including three projections or legs 539, in other embodiments, imaging head 126 may additionally include a greater or fewer number of such legs.

Overall, printing system 20,120 and 420 allow media printhead adjustment while lifting and protecting the printheads in a reliable and effective manner. Deflectors 222 and 522 protect printhead nozzle plates 230 by deflecting media away from nozzle plates 230. Preload mechanisms 42, 43,142 and 443 reduce the amount of force on an imaging head must absorb prior to imaging head 126 being lifted away from table 200 and the colliding medium. At the same time, the magnetic attraction between positioner 40 and base 36 retains the positioning of imaging head 26 or 126 relative to media transport 24,124 during vibration. Uni-directional dampener 44,144 controls maximum descent speed of imaging head 26 to reduce potential damage to imaging head 126 upon such descent and to reduce or eliminate air ingestion into printheads 32, 218. Although printing systems 20,120 and 420 have been illustrated as incorporating all of the above-described features, in other embodiments, systems may include fewer than all of such features. Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a base;

a mount movably coupled to the base and configured to carry an imaging head; and a dampener operably coupled between the mount and the base and configured to dampen movement of the mount in a first direction towards media to be printed upon to a greater degree than in a second direction away from media to be printed upon.

2. The apparatus of claim 1 further comprising:

a first surface coupled to the base; and a second surface coupled to the mount, wherein the second surface engages the first surface to limit movement of the mount in the first direction.

3. The apparatus of claim 2, wherein the first surface and the second surface are magnetically attracted towards one another.

4. The apparatus of claim 3, wherein one of the first surface and the second surface is adjustably supported relative to the other of the first surface and the second surface.

5. The apparatus of claim 4, wherein the second surface is adjustable relative to the mount so as to be movable between and selectively retained in one of a plurality of positions relative to the first surface.

6. The apparatus of claim 5 further comprising a pin providing the second surface and having a threaded portion screwed to the mount, wherein rotation of the pin moves the second surface relative to the first surface.

7. The apparatus of claim 6 further comprising a knob coupled to the pin and configured to facilitate manual rotation of the pin.

8. The apparatus of claim 6, wherein the pin includes a knurled surface and wherein the apparatus further comprises a projection in engagement with the knurled surface.

9. The apparatus of claim 6, wherein the pin includes a magnet.

10. The apparatus of claim 2 further comprising a spring resiliently biasing the mount in the second direction opposite to the first direction.

11. The apparatus of claim 10 further comprising a pin slidably coupled to the mount and including a shoulder and a terminal end opposite the first surface, wherein the spring is captured between the shoulder and the mount.

12. The apparatus of claim 10 further comprising:

a deflector configured to engage media; and a shaft coupled to the deflector and having a shoulder, wherein the spring is captured between the shoulder and the mount.

13. The apparatus of claim 1 further comprising a rack coupled to one of the base and the mount, wherein the dampener comprises a rotary dampener coupled to the other of the base and the mount.

14. The apparatus of claim 1 further comprising a locking mechanism configured to releasably lock the mount relative to the base.

15. The apparatus of claim 1 further comprising an imaging head carried by the mount.

16. The apparatus of claim 15, wherein the imaging head is removably coupled to the mount.

17. The apparatus of claim 1 further comprising a media transport coupled to the base.

18. The apparatus of claim 17, wherein the media transport is configured to move media in a first direction and wherein the base is configured to move relative to the media transport in a second direction perpendicular to the first direction.

19. The apparatus of claim 1, wherein the mount is configured to linearly slide relative to the base.

20. An apparatus comprising:

a base;

a mount movably coupled to the base and configured to carry an imaging head;

a first surface coupled to the base; and a second surface coupled to the mount, wherein the second surface engages the first surface to limit movement of the mount and wherein the first surface and the second surface are magnetically attracted towards one another.

21. The apparatus of claim 20, wherein one of the first surface and the second surface is adjustably supported relative to the other of the first surface and the second surface.

22. The apparatus of claim 21, wherein the second surface is adjustable relative to the mount so as to be movable between and selectively retained in one of a plurality of positions relative to the first surface.

23. The apparatus of claim 22 further comprising a pin providing the second surface and having a threaded portion screwed to the mount, wherein rotation of the pin moves the second surface relative to the first surface.

24. The apparatus of claim 23 further comprising a knob coupled to the pin and configured to facilitate manual rotation of the pin.

25. The apparatus of claim 23, wherein the pin includes a knurled surface and wherein the apparatus further comprises a projection in engagement with the knurled surface.

26. The apparatus of claim 20 further comprising an imaging head carried by the mount.

27. An apparatus comprising:

a base;

a mount movably coupled to the base for vertical movement relative to the base and configured to carry an imaging head; and a spring applying an upward vertical force to the mount while the mount remains stationary relative to the base.

28. The apparatus of claim 27 further comprising:

a first surface coupled to the base; and a pin slidably coupled to the mount and including a shoulder and a terminal end opposite the first surface, wherein the spring is captured between the shoulder and the mount.

29. The apparatus of claim 28 further comprising a second surface coupled to the mount, wherein the second surface engages the first surface to limit movement of the mount relative to the base.

30. The apparatus of claim 29, wherein the first surface and the second surface are magnetically attracted towards one another.

31. The apparatus of claim 27 further comprising:

a deflector configured to engage media; and a shaft coupled to the deflector and having a shoulder, wherein the spring is captured between the shoulder and the mount.

32. The apparatus of claim 27 further comprising an imaging head carried by the mount.

33. A method comprising:

raising an imaging head to a first position in response to engagement with a medium; and dampening falling movement of the head from the first position with a dampener.

34. An apparatus comprising:

a base;

a mount movably coupled to the base and configured to carry an imaging head;

a dampener operably coupled between the mount and the base and configured to dampen movement of the mount in a first direction to a greater degree than in a second direction opposite to the first direction; and a rack coupled to one of the base and the mount, wherein the dampener comprises a rotary dampener coupled to the other of the base and the mount.

35. An apparatus comprising:

a base;

a mount movably coupled to the base and configured to carry an imaging head;

a dampener operably coupled between the mount and the base and configured to dampen movement of the mount in a first direction to a greater degree than in a second direction; and a first surface coupled to the base;

a second surface coupled to the mount, wherein the second surface engages the first surface to limit movement of the mount in the first direction;

a spring resiliently biasing the mount in the second direction opposite to the first direction;

a deflector configured to engage media; and a shaft coupled to the deflector and having a shoulder, wherein the spring is captured between the shoulder and the mount.

* * * * *